US005407708A

United States Patent [19]

Lovin et al.

[11] Patent Number: 5,407,708

[45] Date of Patent: Apr. 18, 1995

[54] METHOD AND APPARATUS FOR APPLYING RADIATION CURABLE INKS IN A FLEXOGRAPHIC PRINTING SYSTEM

[75] Inventors: Joseph Lovin, Greer; Lee W. Keller, Landrum, both of S.C.

[73] Assignee: W.R. Grace & Co.-Conn., Duncan, S.C.

[21] Appl. No.: 187,948

[22] Filed: Jan. 27, 1994

[51] Int. Cl.[6] ..... B05D 1/36

[52] U.S. Cl. ..... 427/493; 101/212; 101/483; 118/211; 118/249; 118/255; 118/620; 427/261; 427/265; 427/384; 427/407.1; 427/504; 427/510; 427/552; 427/558; 427/582

[58] Field of Search ..... 427/493, 504, 510, 552, 427/558, 582, 261, 265, 384, 407.1; 118/620, 255, 211, 249

[56] References Cited

U.S. PATENT DOCUMENTS 3,531,317 9/1970 Patheiger et al. ..... 117/93

3,850,675 11/1974 Miller ..... 117/93

*Primary Examiner*—Bernard Pianalto

[57] ABSTRACT

A system and method for the printing of substrates for use in food packaging and, more particularly, a flexographic printing system and method for applying and curing radiation cured inks to a flexible, heat shrinking web employing a combination of UV radiation and EB radiation.

13 Claims, 1 Drawing Sheet

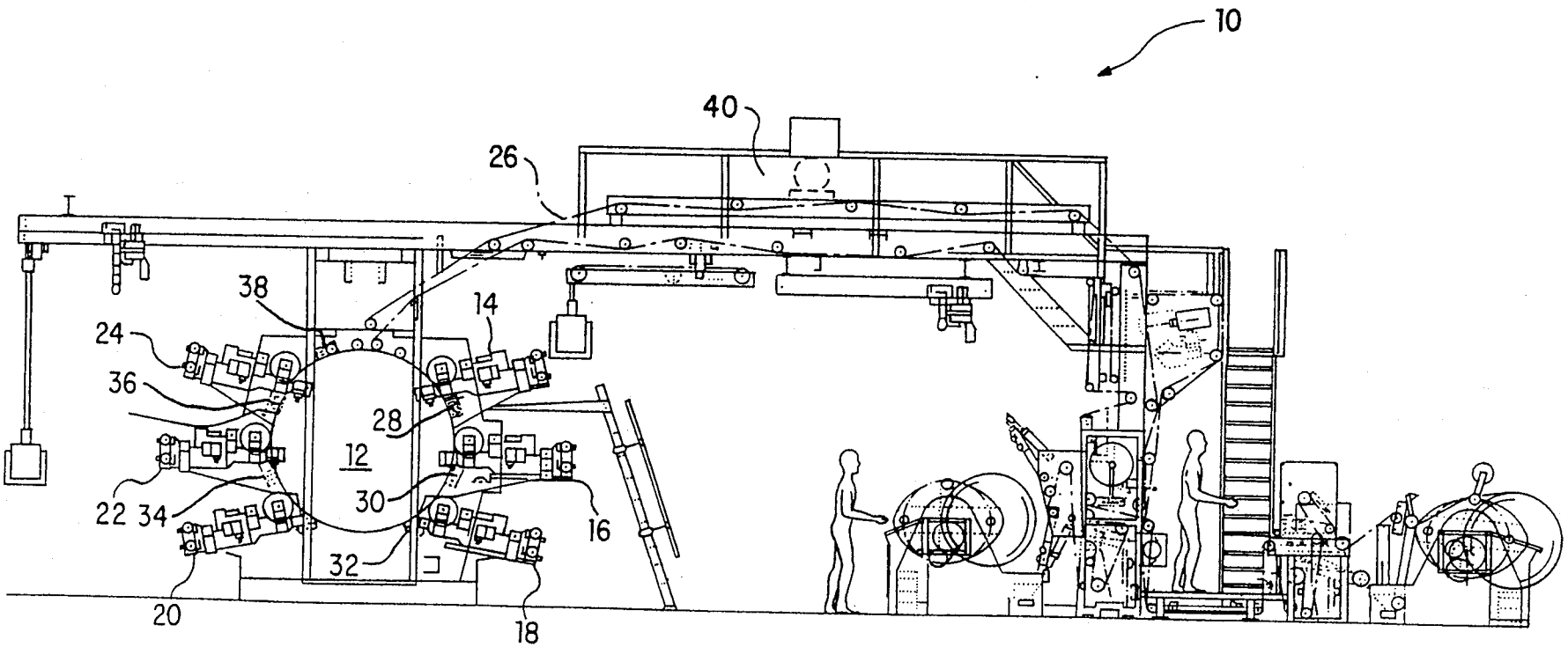
10
40
26
14
16
18
28
12
30
32
38
24
36
22
34
20

METHOD AND APPARATUS FOR APPLYING RADIATION CURABLE INKS IN A FLEXOGRAPHIC PRINTING SYSTEM

BACKGROUND OF THE INVENTION

The present invention relates to a system and method for the printing of substrates for use in food packaging and, more particularly, a flexographic printing system and method for applying and curing radiation curable inks to a flexible, heat shrinkable web.

In the food packaging art flexographic printing processes and apparatus have been employed for applying print media to a flexible web of, for example, plastic material which is thereafter used for packaging food products. The flexographic printing presses employed in such an application utilize a large central impression drum about which individual print stations are radially arrayed. Each of the print stations prints or lays down an individual color on the web. During the flexographic printing process it is necessary to dry the color laid down at a print station sufficiently before it reaches the next print station so as to prevent smearing or pick-off of the ink at the succeeding print station.

Heretofore, flexographic printing systems and methods employed solvent based ink systems or water based ink systems which allowed for the interstation drying to be accomplished by blowing hot air on the substrate or web being printed. There are a number of disadvantages associated with these known, systems and methods.

A major disadvantage associated with solvent based ink systems results from the fact that the solvents in the ink systems are evaporated from the inks during the ink drying process thereby releasing volatile organic chemicals into the atmosphere. Today there are increasing government regulations which require the reduction and eventually the total elimination of the emission of these volatile organic chemicals to the atmosphere.. In addition to the emissions problem noted above, there is an inherent explosive hazard associated with solvent ink printing systems which are heat dried. A third and particularly troubling problem associated with the food packaging art is the inherent shrink problem which results from heat curing solvent ink systems on heat shrinkable flexible webs which are used extensively in the food packaging art. In order to avoid shrinkage very long ovens must be employed to gradually dry the web.

Water based ink systems have been increasingly used in flexographic printing systems and methods in an effort to eliminate the emissions and ,explosive hazard problems associated with solvent based ink systems as noted above. Water based ink systems, however, are subject to hot air blowing for interstation drying during flexographic printing and, therefore, suffer from the problems associated with printing on heat shrinkable flexible webs.

Radiation curable ink systems have been used in the past in various printing systems. For example, in offset printing systems ink systems which are cured by ultraviolet (UV) radiation are known in the art. These radiation curable ink systems require heavy loading of the ink with photo-initiators to promote the final ink curing by ultraviolet radiation. Such an ink system is not suitable for printing flexible, heat shrinkable substrates for use in food packaging for the simple reason that the high loading of photo-initiators required to promote ink curing leads to high amounts of migratable or extractable monomers. The high amount of migratable or extractable monomers would fail to meet FDA requirements for packaging materials having incidental food contact. FDA requires less than 50 parts per billion migratable or extractable monomers as measured in FDA extraction tests. In addition to the problem associated with migratable or extractable monomers, photo-initiators are extremely expensive and thus the radiation curable inks used with ultraviolet radiation curable systems are costly. A further problem associated with ultraviolet (UV) radiation curable ink systems is the high level of energy input required to affect final curing of the ink system. Food packaging applications are often highly abusive applications and, therefore, high energy level input is required for final curing of these ink systems to a point where they can be successfully used on the outside surface of the package. When applying a UV curable ink system to a flexographic printing system further problems arise. The nature of the flexographic printing system which required a plurality of radially arrayed printing stations would require individual ultraviolet radiation systems to be incorporated between each printing station for curing the ink laid down at the printing station before printing in a successive printing station. In light of the high energy level input required by each of these ultraviolet curing and drying systems, energy costs for operating a flexographic printing system employing ultraviolet radiation curable inks does not appear to be commercially viable, particularly for heat shrinkable webs. In addition, high intensity UV lamps radiate about 50% of their energy as infrared energy which results in a heating of the central impression drum which must be disaffected.

Radiation curable ink systems which are cured by electron beam (EB) radiation are known in the prior art. These EB radiation curable ink systems. however are not adaptable for use in flexographic printing systems in that the electron beam generators are extremely bulky in size and, therefore, are not suitable for interstation use in a flexographic printing system. In addition, the electron beam generators are extremely costly and, therefore, could not be economically used in a flexographic printing system which would require up to, for example, 8 generators in a single printing system.

Naturally, it would be highly desirable to provide a system and method for the printing of substrates for use in food packaging and, more particularly, a flexographic printing system and method for applying and curing inks to a flexible, heat shrinkable web which overcomes the problems associated with known printing systems as discussed above.

SUMMARY OF THE INVENTION

It is a principle object of the present invention to provide a flexographic printing system and method for applying and curing radiation curable inks to a flexible, heat shrinkable web.

It is a further object of the present invention to provide a system as above which combines ultraviolet and electron beam ink curing systems and allows for the utilization of radiation curable inks with low levels of both ultraviolet and electron beam energy.

It is a further object of the present invention to provide a system as above which reduces or completely eliminates the emission of volatile organic chemicals to the atmosphere.

It is a still further object of the present invention to provide a system as above which eliminates the explosive hazards associated with solvent ink printing systems.

It is another further object of the present invention to provide a system as above which is usable with radiation curable ink systems having a relatively small amount of photo-initiators.

It is yet a further object of the present invention to provide a system as set forth above which reduces or substantially eliminates the amount of extractable or migratable monomers in the final product.

It is yet a still further object of the present invention wherein the ink is grafted to the heat shrinkable, flexible substrate.

It is another still further object of the present invention to provide a system as set forth above wherein the final product is usable in an abusive food packaging environment.

The foregoing objects and advantages are obtained by the system and method of the present invention.

In accordance with the present invention, a system is provided for applying and curing radiation curable inks to a substrate at successive printing stations.. The system comprises a first print station having means for applying a first coating of a radiation curable ink to a substrate, an ultraviolet (UV) radiation means downstream of the first print station for partially curing the first coating of ink on the substrate so as to prevent pick-off and smearing at a subsequent print station, a second print station downstream of the UV radiation means for applying a second coating of a radiation curable ink to the substrate, and an electron beam radiation means downstream of the second print station for finally curing the first coating of ink and the second coating of ink.

In a preferred embodiment of the present invention, the system is a flexographic printing system having a central impression cylinder, said substrate is a flexible, heat shrinkable web, and the first and second print stations each include a printing cylinder wherein the web passes between the central impression cylinders and the printing cylinders. In typical flexographic printing systems up to 8 print stations are employed and, in accordance with the present invention, a UV radiation means is located between adjacent print stations for partially curing the coating of ink applied at the preceding print station.

The radiation curable ink employed in the flexographic print system of the invention comprises preferably less than 10% by weight photo-initiators with respect to the total ink composition. The input of each UV radiation means employed in the flexographic printing system of the present invention is preferably less than 300 watts/inch of web width. The input of the electron beam radiation means is preferably less than 20 KW.

The method of the present invention broadly comprises the steps of: providing a substrate; providing a radiation curable ink; applying a first coating of the radiation curable ink to the substrate; irradiating the coated substrate with low level UV radiation for partially curing the first coating of ink on the substrate so as to prevent pick-off and smearing of the first ink coating upon application of a second ink coating to the substrate; thereafter applying a second coating of the radiation curable ink to the substrate; and further radiating the coated substrate with EB radiation for finally curing the first coating and the second coating wherein the ink is adhered to the substrate. In accordance with the preferred embodiment of the present invention, the substrate is a flexible, heat shrinkable web suitable for use for packaging food products. The radiation curable ink comprises less than 10% by weight photo-initiators with respect to the total ink composition. The interstation UV radiation is applied at a low level of 300 watts/inch of web width and the EB radiation is likewise applied at a low level of 20 KW.

Still other details of the system and method of the present invention, as well as other objects and advantages of the present invention, are set out in the following description and drawing.

BRIEF DESCRIPTION OF THE DRAWING

The FIGURE is a schematic representation of a flexographic printing system which employs radiation curable inks and a combined UV-EB ink curing system in accordance with the present invention.

DETAILED DESCRIPTION OF THE INVENTION

Referring to the drawings, FIG. 1 illustrates a flexographic printing system in accordance with the preferred embodiment of the present invention. While the present invention will be described with reference to a flexographic printing system, it should be appreciated that the combined UV-EB ink curing system that allows for the utilization of radiation curable inks may be applied to other printing systems in addition to flexographic printing systems.

With reference to FIG. 1, the flexographic printing system 10 comprises a central impression cylinder 12 and a plurality of print stations 14, 16, 18, 20, 22 and 24. A flexible web 26 passes between the central impression cylinder 12 and the print stations. In the preferred embodiment of the system and method of the present invention, the flexible web 26 is a heat shrinkable flexible web suitable for use in the food packaging art.

As shown in FIG. 1, a plurality of ultra violet radiation means such as lamps, 28, 30, 32, 34 and 36 respectively, are located between the print stations 14, 16, 18, 20, 22 and 24 for partially curing the ink deposited on the web 26 at a downstream station (subsequent print station) prior to introduction into each successive print station. In accordance with the preferred embodiment of the present invention, an additional UV radiation means 38 is provided downstream of the last print station 24 for partially curing the radiation curable ink applied to the web at the station; however, a UV radiation means downstream of the last station is optional, as the web may proceed directly from the last print station to the electron beam radiation means discussed below.

An electron beam radiation means in the form of an electron beam generator 40 is located downstream of the final print station 24 and UV radiation means 38. The electron beam generator 40 finally cures the ink deposited at each of the print stations which was partially cured by the ultra violet radiation means.

In accordance with the system and method of the present invention for the printing of substrates for use in the packaging industry, the print stations 14, 16, 18, 20, 22 and 24 apply to the web a radiation curable ink which is capable of being partially cured by UV radiation means 28, 30, 32, 34, 36 and 38 interposed after the print stations 14, 16, 18, 20, 22 and 24 respectively. Thereafter, the partially cured ink is finally cured by passing the web through electron beam radiation generator 40. As noted above, radiation curable inks for printing systems are well known and readily available. A particularly suitable radiation curable ink for the system and method of the present invention is available from Coates Lorilleno and is proprietary to Coates Lorilleno. As the radiation curable ink employed in the system and method of the present invention need only be partially cured by UV radiation, the amount of photo-initiators in the radiation curable ink can be reduced and are at a level of less than 10% by weight with respect to the total ink composition. The low amounts of photo-initiators in the radiation curable ink composition leads to a final product for food packaging which meets FDA requirements for extractable or migratable monomers. The FDA requires less than 50 parts per billion (ppb) migratable or extractable monomers in packaging material having incidental contact with food. The system and method of the present invention is usable with radiation curable ink compositions which lead to levels of extractable or migratable monomers in the final packaging product of less than 5 ppb.

As noted above, the ink composition applied to the web is partially cured by ultra violet radiation between successive print stations of the flexographic printing system. The term "partially cured" as used in the instant application means that the ink is cured to a degree sufficient to prevent pick off (lift off) and smearing of the ink at the subsequent printing station. Thus, the ink applied at a subsequent print station is sufficiently cured prior to passing to the successive print station so as to eliminate any pick off or smearing of the ink at the successive print station. As only partial curing needs to be accomplished at each ultra violet radiation means, the energy input to each of the stations can be reduced and, in accordance with the present invention, is less than or equal to 300 watts/inch of web width. The ink need only to be partially cured as final cure of the ink will take place under electron beam radiation in generator 40. As a result of the low level of UV radiation required for partially curing when compared to finally curing by UV radiation, energy costs for operation of the system and method are greatly reduced.

As noted above, final cure of the ink applied to the flexible, heat shrinkable takes place by electron beam radiation in generator 40. The term "final cure" as used in the instant application means that the ink is cured to the point where all the monomers have been reacted. As the inks are partially cured prior to electron beam radiation, the energy levels required for electron beam radiation are reduced and, in accordance with the present invention, are operated at levels of less than or equal 20 KW.

The flexible webs employed in the preferred embodiment of the present invention for flexographic printing of radiation curable inks are heat shrinkable webs used for food packaging formed of a polymeric thermoplastic material. Naturally, the system and method of the present invention may be used in combination with any flexible web substrate.

In operation, the substrate in the form of a flexible, heat shrinkable web is fed and passes between the central impression cylinder 12 and the print stations 14, 16, 18, 20, 22 and 24 of the printing system 10. At the first print station 14 a first coating of a radiation curable ink is applied to the substrate. An ultra violet radiation generation means such as a lamp 28 is positioned downstream of the first print station 14 between print stations 14 and 16 for partially curing the ink applied to the web at the first print station 14. The partial curing is sufficient to prevent pick off and smearing of the ink at the subsequent print station 16 where a second coating of the radiation curable ink is applied to a substrate. The operation of ink application and partial curing continues at each subsequent print stations 16, 18, 20, 22 and 24 and ultra violet generation means 30, 32, 34, 36 and 38 of the flexographic printing system. After passing through the final print station 24 and UV radiation generating means 38, the web 26 is fed to the EB generator 40 where the web is exposed to electron beam radiation for final curing of the ink on the substrate.

The system and method for the printing of substrates for use in food packaging offer a number of advantages over prior art systems. By employing a combined ultra violet and electron beam ink curing system which allows for the utilization of radiation curable inks with low levels of ultra violet and electron beam energy, the use of solvent ink systems is avoided. Thus, the system of the present invention completely eliminates the emission of volatile organic chemicals to the atmosphere and the explosive hazards associated with solvent ink printing systems. In addition, by using a combined ultra violet and electron beam ink curing system, final curing by ultra violet radiation is eliminated. Accordingly, the amount of photo-initiators used in the radiation curable ink composition can be greatly reduced which leads to a substantial elimination of the amount of extractable or migratable monomers resulting in the final product. By employing electron beam radiation for final curing of the radiation curable inks in the system and method of present invention the ink applied to the substrate is not only cured but is adhered to the heat shrinkable, flexible substrate. Without being bound by an explanation of the physical or chemical mechanism underlying the adherence of the ink to the substrate, it is thought that the radiation curable ink becomes grafted to the substrate. The term "grafted" is used in the context of surface grafting as described in "Graft Copolymers," pp. 551–579, *Encyclopedia of Polymer Science and Engineering*, 2nd Ed., Vol. 7, John Wiley & Sons, Inc. (1987), incorporated herein by reference. Grafting has the advantage that as the substrate shrinks upon subsequent heating, the printed indicia on this flexible, shrinkable substrate shrinks therewith with the result being a quality printed final product. Final curing by EB radiation also leads to a product which can withstand the abusive environment associated with food packaging. Finally, as a result of the low energy levels of radiation employed in the system and method of the present invention, heat shrinkable webs may be treated without fear of the webs shrinking during printing due to increased heat levels which may occur as a result of final curing by UV radiation.

It is apparent there has been provided in accordance with this invention a system and method for the printing of substrates with radiation curable inks for use in food packaging applications which fully satisfies the objects, means and advantages set forth herein. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A system for applying and curing radiation curable inks to a substrate at successive printing stations, said system comprising:

a first print station having means for applying a first coating of a radiation curable ink to a substrate;

UV radiation means downstream of said first print station for partially curing the first coating of ink on the substrate so as to prevent pick-off and smearing at a subsequent print station;

a second print station downstream of said UV radiation means for applying a second coating of a radiation curable ink to the substrate; and electron beam radiation means downstream of said second print station for finally curing the first coating of ink and the second coating of ink.

2. A system according to claim 1 wherein said substrate is a heat shrinkable flexible web.

3. A system according to claim 2 wherein said system is a flexographic printing system having a central impression cylinder and said first and second print stations each include a printing cylinder wherein the substrate passes between the central impression cylinder and the printing cylinders.

4. A system according to claim 3 further comprising n print stations successively positioned about the central impression cylinder and a UV radiation means located between each successive print station for partially curing the coating of ink applied at a subsequent print station where n is greater than 2.

5. A system according to claim 4 wherein the input of said UV radiation means is less than 300 watts/inch of web and the input of the electron beam radiation means is less than 20 KW.

6. A system according to claim 3 wherein said radiation curable ink comprises less than 10% by weight photo-initiators with respect to the total ink composition.

7. A method for applying and curing radiation curable inks to a substrate at successive printing stations, said method comprising:

providing a substrate; applying a first coating of the radiation curable ink to a substrate;

irradiating the coated substrate with low level UV radiation for partially curing the first coating of ink on the substrate so as to prevent pick-off and smearing of the first ink coating upon application of a second ink coating to the substrate;

thereafter applying a second coating of a radiation curable ink to the substrate; and further irradiating the coated substrate with electron beam radiation for finally curing the first coating and the second coating wherein the ink is adhered to the substrate.

8. A method according to claim 7 wherein said substrate is a flexible web.

9. A method according to claim 8 further comprising:

forming said flexible web from a heat shrinkable material comprising a polymeric thermoplastic material.

10. A method according to claim 9 wherein said radiation curable ink comprises less than 10 weight percent photo-initiators with respect to the total ink composition.

11. A method according to claim 7 further comprising:

applying n coatings of a radiation curable ink to said substrate; and irradiating the coated substrate with UV radiation between each application of the n coating prior to final irradiating with electron beam radiation where n is greater than 2.

12. A method according to claim 7 wherein said low level UV radiation is applied at a level of 300 watts/inch of web width.

13. A method according to claim 12 wherein said EB radiation is applied at a level of 20 KW.

* * * * *

US005407708B1

REEXAMINATION CERTIFICATE (3173rd)

United States Patent [19]

[11] B1 5,407,708

Lovin et al.

[45] Certificate Issued Apr. 8, 1997

[54] METHOD AND APPARATUS FOR APPLYING RADIATION CURABLE INKS IN A FLEXOGRAPHIC PRINTING SYSTEM

[75] Inventors: Joseph Lovin, Greer; Lee W. Keller, Landrum, both of S.C.

[73] Assignee: W. R. Grace & Co.-Conn., Duncan, S.C.

Reexamination Request:
No. 90/004,373, Sep. 20, 1996

Reexamination Certificate for:

| | |
|---|---|
| Patent No.: | **5,407,708** |
| Issued: | **Apr. 18, 1995** |
| Appl. No.: | **187,948** |
| Filed: | **Jan. 27, 1994** |

[51] Int. Cl.[6] ..... B05D 1/36

[52] U.S. Cl. ..... 427/493; 101/212; 101/483; 118/211; 118/249; 118/255; 118/620; 427/261; 427/265; 427/384; 427/407.1; 427/504; 427/510; 427/552; 427/558; 427/582

[58] Field of Search ..... 101/212, 483; 118/211, 249, 255, 620; 427/261, 265, 384, 407.1, 504, 510, 552, 558, 582

[56] References Cited

U.S. PATENT DOCUMENTS

| | | | |
|---|---|---|---|
| 3,531,317 | 9/1970 | Patheiger et al. | 117/93 |
| 3,661,614 | 5/1972 | Bassemir et al. | 117/38 |
| 3,850,675 | 11/1974 | Miller | 117/93 |
| 3,936,557 | 2/1976 | Watt | 428/211 |
| 4,070,497 | 1/1978 | Wismer et al. | 427/44 |
| 4,197,344 | 4/1980 | Tshudy | 428/212 |
| 4,309,452 | 1/1982 | Sachs | 427/44 |
| 5,330,799 | 7/1994 | Sandor et al. | 427/510 |
| 5,379,697 | 1/1995 | Ertl | 101/424 |

FOREIGN PATENT DOCUMENTS

| | | |
|---|---|---|
| 346229 | 12/1927 | Belgium . |
| 0089629 | 3/1983 | European Pat. Off. . |
| 3404723 | 9/1985 | Germany . |
| 57-059968 | 7/1982 | Japan . |
| 57-157785 | 12/1982 | Japan . |
| 57-174209 | 1/1983 | Japan . |

*Primary Examiner*—Bernard D. Pianalto

[57] ABSTRACT

A system and method for the printing of substrates for use in food packaging and, more particularly, a flexographic printing system and method for applying and curing radiation cured inks to a flexible, heat shrinking web employing a combination of UV radiation and EB radiation.

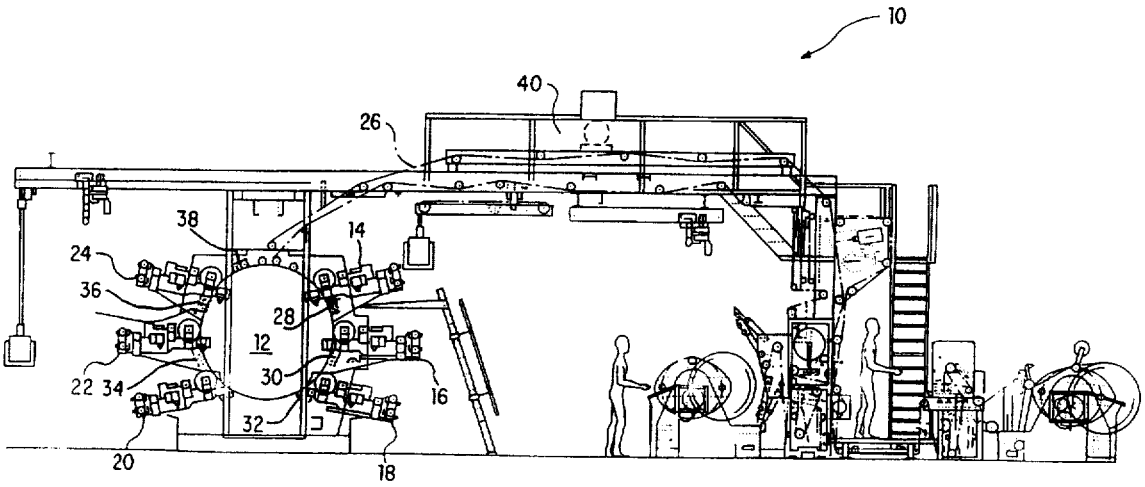

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 3 is cancelled.

Claims 1, 4, 6 and 7 are determined to be patentable as amended.

Claims 2, 5 and 8–13, dependent on an amended claim, are determined to be patentable.

1. A *flexographic printing* system for applying and curing radiation curable inks to a substrate at successive printing stations, said system comprising:

a first print station having means for applying a first coating of a radiation curable ink to a substrate;

UV radiation means downstream of said first print station for partially curing the first coating of ink on the substrate so as to prevent pick-off and smearing at a subsequent print station;

a second print station downstream of said UV radiation means for applying for applying a second coating of a radiation curable ink to the substrate; and electron beam radiation means downstream of said second print station for finally curing the first coating of ink and the second coating of ink[.];

*said flexographic printing system having a central impression cylinder and said first and second print stations each include a printing cylinder wherein the substrate passses between the central impression cylinder and the printing cylinders.*

4. A system according to claim [3] *1* further comprising n print stations successively positioned about the central impression cylinder and a UV radiation means located between each successive print station for partially curing the coating of ink applied at a subsequent print station where n is greater than 2.

6. A system according to claim [3] *1* wherein said radiation curable ink comprises less than 10% by weight photoinitiators with respect to the total ink composition.

7. A method for applying and curing radiation curable inks to a substrate at successive printing stations *in a flexographic printing system,* said method comprising:

*providing a central impression cylinder, a first print station and a second print station, said first and second print stations being positioned about said central impression cylinder;* providing a substrate, applying a first coating of the radiation curable ink to [a] *the* substrate *at said first print station*;

irradiating the coated substrate with low level UV radiation for partially curing the first coating of ink on the substrate so as to prevent pick-off and smearing of the first ink coating upon application of a second ink coating to the substrate;

thereafter applying a second coating of a radiation curable ink to the substrate *at said second print station*; and further irradiating the coated substrate with electron beam radiation for finally curing the first coating and the second coating wherein the ink is adhered to the substrate.

* * * * *